US006540474B2

(12) United States Patent
Marx et al.

(10) Patent No.: US 6,540,474 B2
(45) Date of Patent: Apr. 1, 2003

(54) SIDE-CHANNEL PUMP

(75) Inventors: Peter Marx, Warbüttel (DE); Cicero Constantin, Melsungen (DE); Jörg Deubner, Bebra (DE)

(73) Assignee: Mannesmann VDO, Frankfurt am Main (DE)

( * ) Notice: Subject to any disclaimer, the term of this patent is extended or adjusted under 35 U.S.C. 154(b) by 0 days.

(21) Appl. No.: 09/885,236

(22) Filed: Jun. 20, 2001

(65) Prior Publication Data

US 2002/0021975 A1 Feb. 21, 2002

(30) Foreign Application Priority Data

Jun. 21, 2000 (DE) ..... 100 30 604

(51) Int. Cl.[7] ..... F04D 5/00
(52) U.S. Cl. ..... 415/55.1
(58) Field of Search ..... 415/55.1, 55.2, 415/55.3, 55.4, 224

(56) References Cited

U.S. PATENT DOCUMENTS

| | | | | | |
|---|---|---|---|---|---|
| 2,045,851 | A | | 6/1936 | Hamilton | 103/96 |
| 2,113,116 | A | | 4/1938 | McMillan | 103/96 |
| 3,257,955 | A | * | 6/1966 | Worst | 415/55.4 |
| 3,915,589 | A | * | 10/1975 | Vander Linden | 415/167.1 |
| 5,577,881 | A | * | 11/1996 | Hablanian | 415/55.1 |
| 5,904,468 | A | * | 5/1999 | Dobler et al. | 415/55.1 |
| 6,231,300 | B1 | * | 5/2001 | Wilhelm et al. | 415/55.1 |

FOREIGN PATENT DOCUMENTS

| | | | |
|---|---|---|---|
| DE | 3427112 | 1/1986 | F04D/5/00 |

* cited by examiner

*Primary Examiner*—Ninh H. Nguyen
(74) *Attorney, Agent, or Firm*—Cohen, Pontani, Lieberman & Pavane

(57) ABSTRACT

A side-channel pump includes guide means for the radial and/or axial guidance of an impeller, the guide means being arranged in the radially outer area of the impeller. The guide means include guide surfaces arranged on the impeller at an intended angle to the ends of the impeller. The frictional losses of the side-channel pump are thereby kept particularly low.

10 Claims, 1 Drawing Sheet

SIDE-CHANNEL PUMP

BACKGROUND OF THE INVENTION

1. Field of the Invention

The present invention relates to a side-channel pump with an impeller arranged rotatably in a pump housing having an inlet channel and an outlet channel, the impeller including rotor blades arranged for pumping a liquid from the inlet channel to the outlet channel, and guide means for guiding the impeller in an axial position and/or a radial position.

2. Description of the Related Art

Side-channel pumps with impellers having rotor blades, inlet and outlet channels, and guide means for guiding the impeller in a radial and/or axial position are often used in motor vehicles for delivering fuel or washer fluid and they are known in practice. The pump housing of the known side-channel pump is composed of two parts which are held at a distance from one another by an intermediate ring having dimensions corresponding to the height of the impeller. As guide means, the known side-channel pump has pockets arranged in the area between the center of the impeller and the area of the rotor blades. The pockets are designed so that a small proportion of the medium to be pumped collects therein. The impeller floats on the medium held in the pockets. Radial forces acting on the impeller are generally absorbed by the bearing arrangement of a drive shaft of an electric motor that drives the side-channel pump.

A problem with the known pump is that the guidance of the impeller is extremely inadequate and generally does not prevent the impeller from rubbing against the housing. The rubbing of the impeller against the housing creates frictional losses which reduce the efficiency of the side-channel pump. The inadequate guidance also causes the gap between the impeller and the pump housing to fluctuate in the area of the rotor blades. The fluctuation in this gap leads to a further reduction in the efficiency of the side-channel pump.

SUMMARY OF THE INVENTION

It is an object of the present invention to provide a side-channel pump such that frictional losses are avoided in as reliable a manner as possible.

The object according to the present invention is met by arranging guide means in the area of a radially outer rim of an impeller of the side-channel pump.

According to the present invention, the guide means extend over only a particularly small area of the impeller. In the area of the radially outer rim, the liquid to be pumped has a particularly high pressure due to friction on the impeller and centrifugal forces. As a result, the guide means arranged at the radially outer rim allow the transmission of large guiding forces to the impeller. The radially outer area may furthermore be manufactured with a particularly high accuracy with a low outlay in manufacture. The present invention obviates the requirement for further component for guiding the impeller. As a result, the cost of the side-channel pump according to the invention is furthermore particularly low.

The guide means may, for example, include a ring with a plurality of individual skids. A further contribution to reducing the cost of manufacturing the side-channel pump according to the invention is made if the guide means have at least one guide surface which lies opposite a corresponding area of the housing with an intended guide clearance.

According to another embodiment of the present invention, a first gap between the area of the impeller that has the rotor blades and the housing is configured independently of a second gap arranged in the area of the guide means. In this embodiment, the guide means have a change in cross section arranged in the area of the rim of the impeller. The areas of the impeller that form the change in cross section are each designed as guide surfaces that lie opposite the housing with an intended guide clearance. As a result, the second gap of the guide clearance that determines the friction and guiding forces on the impeller is set to an intended value independently of the first gap in the area of the rotor blades, the first gap determining the characteristic of the feed pump.

According to a further embodiment of the present invention, the change in cross section may be produced at a particularly low cost if the change in cross section is abrupt, i.e., a step change.

The impeller may be guided both axially and radially by a single guide surface if the change in cross section is designed as a chamfer, i.e., a beveled edge.

In side-channel pumps according to the present invention provided for delivering fuel or washer fluid, the change in cross section designed as a chamfer provides the impeller with adequate radial and axial guidance if the guide surface is arranged at an angle of about 30 to 60° to the end of the impeller.

It is often sufficient to support the impeller axially against gravitational force in only one direction and to arrange the electric motor for driving the impeller above the impeller if the side-channel pump according to the present invention is provided for delivering full or washer fluid. In this case, the guide means require a single guide surface on only one side. In a further embodiment of the present invention, the gap between the impeller and the housing in the area of the rotor blades may be set with particular accuracy if the rim has respective guide surfaces, each facing one end. This arrangement contributes to a further improvement in the efficiency of the side-channel pump according to the present invention.

According to yet another embodiment of the present invention, the requirement for costly intermediate rings to be inserted into the pump housing may be avoided by arranging two mutually opposite housing parts surrounding the impeller so that they border one another in the area of the maximum diameter of the impeller. It is thereby furthermore possible to set the gap with particularly narrow tolerances. This contributes to a further increase in the efficiency of the side-channel pump according to the present invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawing, wherein like reference characters denote similar elements throughout the several views.

DETAILED DESCRIPTION OF THE PRESENTLY PREFERRED EMBODIMENTS

Figure 1:
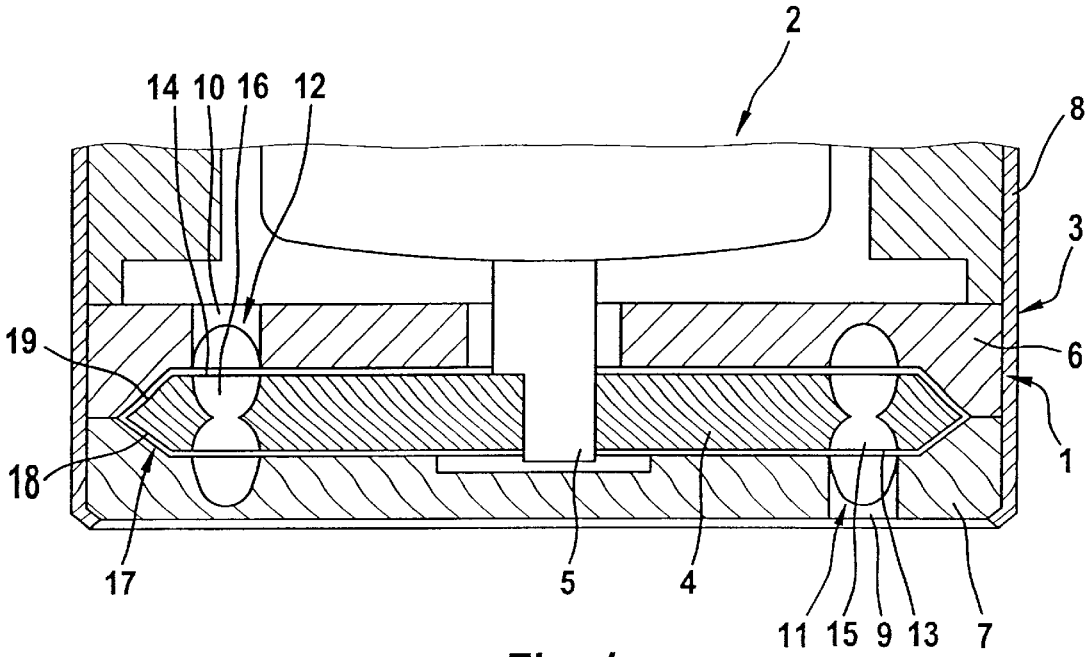
FIG. 1 is a longitudinal sectional view showing a side-channel pump according to an embodiment of the present invention.

FIG. 1 is a longitudinal sectional view of a side-channel pump 1 according to the present invention showing the adjoining areas of an electric motor 2 connected thereto. The side-channel pump 1 includes an impeller 4 having two planar ends 27, 28 and rotatably arranged in a housing 3. The impeller 4 is arranged on a motor shaft 5 of the electric motor 2. The housing 3 includes first and second housing parts 6, 7 which are spaced apart and a sheet-metal strip 8 that has been rolled into shape. The sheet-metal strip 8 holds the side-channel pump 1 in an intended position relative to the electric motor 2. An inlet channel 9 is arranged in the second housing part 7 and an outlet channel 10 is arranged in the first housing part 6. The inlet channel 9 and the outlet channel 10 are each connected to partially annular channels 11, 12. In the respective radial areas of the partially annular channels 11, 12, the impeller 4 has blade chambers 15, 16 delimited by rotor blades 13, 14. In this area, the housing 3 is close to the impeller 4 to form sealing gaps. In a radially outer area of the side channel pump 1, i.e., radially outside of the rotor blades 13, 14, guide means 17 are arranged for the radial and axial guidance of the impeller 4. The guide means 17 include two surfaces which produce reductions in cross section between the first and second housing parts 6, 7. These surfaces are designed as guide surface 18, 19 and extend from the central area of the rim as far as the ends of the rim. In the area of the guide surfaces 18, 19, the impeller 4 lies opposite the housing 3 with an intended guide clearance. The first and second housing parts 6, 7 border one another in the area radially outside of the maximum diameter of the impeller 4.

During rotation of the impeller 4, a liquid to be pumped is pumped from the inlet channel 9 to the outlet channel 10. During this pumping process, a small quantity of the liquid to be pumped enters the gap between the impeller 4 and the housing 3 in the area of the rotor blades 13, 14. Frictional and centrifugal forces carry this liquid into the area of the guide means 17. The liquid produces forces in the axial and radial directions on the impeller 4 depending on the distances between the guide surfaces 18, 19 and the housing 3, i.e., the intended guide clearance, and on the angle of the guide surfaces 18, 19 relative to the ends of the impeller 4. The impeller 4 may be guided axially and radially by appropriate configuration of the guide means 17. In the embodiment of FIG. 1, the guide surfaces 18, 19 are of mirror-image configuration. However, the guide surface 19 closest to the electric motor 2 may be dispensed with if a rotor of the electric motor 2 rests on the impeller 4, thereby producing an intended axial force. The guide surfaces 18, 19 or that area of the housing parts 6, 7 that lies opposite the guide surfaces 18, 19 may have coatings with dry-running properties and/or for reducing sliding friction. Furthermore, the guide surfaces 18, 19 may have pockets such as those used in sliding-contact bearings to receive the liquid to be pumped.

Figure 2:
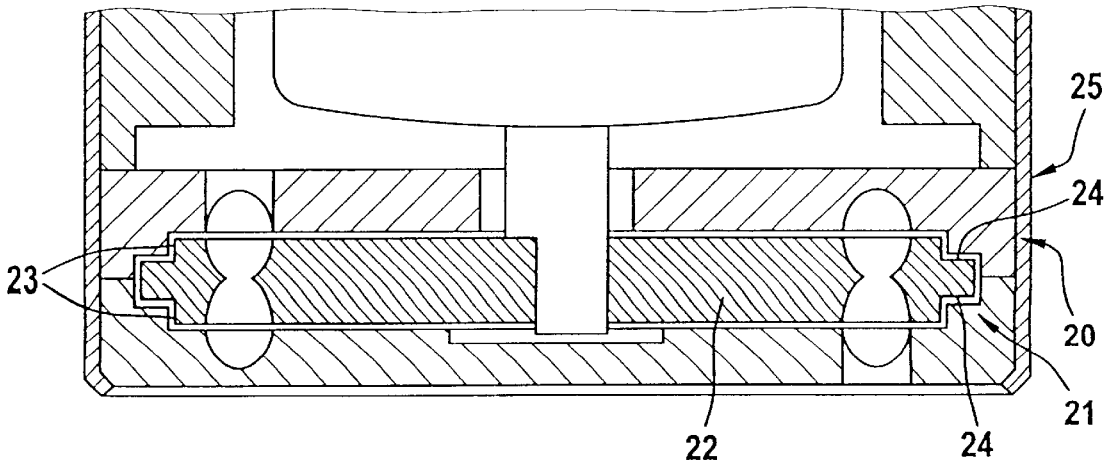
FIG. 2 is a longitudinal sectional view showing a side-channel pump according to a further embodiment of the present invention.

FIG. 2 shows a side-channel pump 20 with an impeller 22 in which guide means 21 have an abrupt reduction in cross section from the central area of the rim to the ends of the impeller 22. Accordingly, the guide means 21 includes a radial guide surface 23 and an axial guide surface 24 in the areas adjoining the ends. A housing 25 of the side-channel pump has a shape corresponding to the guide surfaces 23, 24. As a result, the impeller 22 has axial and radial sliding-contact bearings in its radially outer area.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A side-channel pump, comprising:

a pump housing having an inlet channel and an outlet channel;

an impeller having two opposing planar ends and rotor blades, said impeller rotatably arranged in said pump housing for pumping a liquid via said rotor blades from said inlet channel to said outlet channel; and guide means arranged for guiding at least one of an axial position and a radial position of said impeller in said pump housing, wherein said guide means are arranged on a rim in a radially outer area of said impeller, said guide means arranged for receiving a portion of the liquid to be pumped during rotation of said impeller at a pressure sufficient for providing a guiding force for the impeller.

2. The side-channel pump of claim 1, wherein said guide means comprise at least one guide surface and said housing comprises a corresponding area which lies opposite said at least one guide surface with an intended guide clearance therebetween.

3. The side-channel pump of claim 2, wherein said at least one guide surface is arranged at an angle of about 30 to 60° to the planar ends of the impeller.

4. The side-channel pump of claim 2, wherein said rim has respective guide surfaces, each facing one of said planar ends of said impeller.

5. The side-channel pump of claim 1, wherein said guide means comprise guide surfaces that form a change in cross section in the area of said rim of said impeller, said guide surfaces that form the change in cross section lie opposite said housing at a guide clearance therebetween.

6. The side-channel pump of claim 5, wherein the change in cross section is abrupt.

7. The side-channel pump of claim 5, wherein the change in cross section is a chamfer.

8. The side-channel pump of claim 5, wherein said guide surfaces are arranged at an angle of about 30 to 60° to said planar ends of said impeller.

9. The side-channel pump of claim 5, wherein each of said guide surfaces faces a respective one of said planar ends of said impeller.

10. The side-channel pump of claim 1, wherein said housing comprises two mutually opposite housing parts surrounding said impeller, said housing parts bordering one another in an area radially outside of a maximum diameter of said impeller.

* * * * *